US011352746B2

(12) United States Patent
Luukkonen et al.

(10) Patent No.: US 11,352,746 B2
(45) **Date of Patent: *Jun. 7, 2022**

(54) PROCESSES AND SYSTEMS FOR THE PULPING OF LIGNOCELLULOSIC MATERIALS

(71) Applicant: ANDRITZ INC., Alpharetta, GA (US)

(72) Inventors: Antti Luukkonen, Beavercreek, OH (US); Christian Radhuber, Weigelsdorf (AT)

(73) Assignee: Andritz Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/884,296

(22) Filed: May 27, 2020

(65) Prior Publication Data

US 2020/0283953 A1 Sep. 10, 2020

Related U.S. Application Data

(62) Division of application No. 15/556,709, filed as application No. PCT/US2016/021921 on Mar. 11, 2016, now Pat. No. 10,724,174.

(60) Provisional application No. 62/131,319, filed on Mar. 11, 2015.

(51) Int. Cl.

| | |
|---|---|
| ***D21C 3/26*** | (2006.01) |
| ***D21C 3/00*** | (2006.01) |
| ***D21C 7/06*** | (2006.01) |
| *D21C 9/02* | (2006.01) |
| *D21C 9/10* | (2006.01) |

(52) U.S. Cl.

CPC ..... *D21C 3/26* (2013.01); *D21C 3/00* (2013.01); *D21C 7/06* (2013.01); *D21C 9/02* (2013.01); *D21C 9/10* (2013.01)

(58) Field of Classification Search

CPC ... D21C 3/26; D21C 3/00; D21C 7/06; D21C 9/02; D21C 9/10

USPC ..... 162/25

See application file for complete search history.

(56) References Cited

U.S. PATENT DOCUMENTS

| | | | | |
|---|---|---|---|---|
| 783,608 A | | 2/1905 | Buhles | |
| 2,851,355 A | | 9/1958 | Ernst et al. | |
| 3,829,357 A | * | 8/1974 | Thompson et al. | D21C 3/18 162/23 |
| 3,873,412 A | | 3/1975 | Charters et al. | |

(Continued)

FOREIGN PATENT DOCUMENTS

| | | |
|---|---|---|
| CN | 1062564 | 7/1992 |
| CN | 1697901 | 11/2005 |

(Continued)

OTHER PUBLICATIONS

Per Naeslund, International Search Report, dated Jun. 23, 2016, pp. 1-4, European Patent Office, Munich, Germany.

(Continued)

*Primary Examiner* — Jacob T Minskey

(74) *Attorney, Agent, or Firm* — Kilpatrick Townsend & Stockton LLP

(57) ABSTRACT

A system and process of producing pulp from lignocellulosic material after the lignocellulosic material has undergone compression (pressurization), maceration and removal of extractives produced during compression and maceration followed by chemical addition, fiberization, digestion (cooking) and further mechanical refining.

7 Claims, 4 Drawing Sheets

(56) References Cited

U.S. PATENT DOCUMENTS

| | | | | |
|---|---|---|---|---|
| 5,320,034 | A * | 6/1994 | Eccleston | D21B 1/22 100/145 |
| 6,123,808 | A | 9/2000 | Bechard et al. | |
| 8,262,851 | B2 | 9/2012 | Aichinger et al. | |
| 10,724,174 | B2 | 7/2020 | Luukkonen et al. | |
| 2004/0256065 | A1 | 12/2004 | Ahmed et al. | |
| 2005/0241785 | A1 | 11/2005 | Peng et al. | |
| 2009/0298149 | A1 | 12/2009 | Wang et al. | |
| 2016/0145276 | A1 | 5/2016 | Alabugin et al. | |
| 2018/0105982 | A1 | 4/2018 | Luukkonen et al. | |

FOREIGN PATENT DOCUMENTS

| | | |
|---|---|---|
| CN | 2832884 | 11/2006 |
| CN | 101122101 | 2/2008 |
| CN | 102011334 | 4/2011 |
| CN | 102605667 | 7/2012 |
| CN | 103696306 | 4/2014 |
| GB | 138911 | 7/1920 |
| WO | 2011156708 | 12/2011 |

OTHER PUBLICATIONS

Per Naeslund, Written Opinion of the International Searching Authority, dated Jun. 23, 2016, pp. 1-4, European Patent Office, Munich, Germany.
Chinese Patent Office, Notification of the First Office Action, dated Sep. 11, 2019, pp. 1-13, Bejing, China.
Christopher Bowen, Office Action, dated May 21, 2019, pp. 1-4, Canada.
Simone Carvalho Rufino, Office Action, dated Dec. 23, 2019, pp. 1-4, Rio de Janeiro, Brazil.
Chilean Patent Office First Office Action, dated Oct. 19, 2018, pp. 1-11, Chile.
Gorski D, Hill J, Engstrand P, Johansson L. "Review: Reduction of Energy Consumption in TMP Refining through Mechanical Pre-Treatment of Wood Chips," Nordic Pulp & Paper Research Journal. 2010; 25(2):1156-161.
U.S. Appl. No. 15/556,709 , Final Office Action, dated May 21, 2020, 8 pages.
U.S. Appl. No. 15/556,709 , Non-Final Office Action, dated Jan. 2, 2020, 9 pages.
U.S. Appl. No. 15/556,709 , Notice of Allowance, dated Jun. 12, 2020, 10 pages.
AU2016228870 , "Notice of Acceptance", dated Apr. 9, 2019, 3 pages.
Application No. CA2979048 , Notice of Allowance, dated Oct. 15, 2020,.
Application No. CN201680018632.8 , Office Action, dated Mar. 9, 2021, 11 pages.
Application No. CN201680018632.8 , Office Action, dated Jul. 17, 2020, 9 pages.
CN201680018632.8 , "Search Report", dated Aug. 30, 2019, 2 pages.
CN201680018632.8 , "Supplemental Search Report", dated Jul. 9, 2020, 2 pages.
Application No. EP16714634.9 , Notice of Decision to Grant, dated Jan. 7, 2019, 2 pages.
Application No. PCT/US2016/021921 , International Preliminary Report on Patentability, dated Sep. 21, 2017, 9 pages.
Brazil Patent Application No. BR112017018968-2, Notice of Allowance, dated Dec. 28, 2021, 4 pages.

* cited by examiner

PROCESSES AND SYSTEMS FOR THE PULPING OF LIGNOCELLULOSIC MATERIALS

CROSS-RELATED APPLICATION

This application is a divisional application that is related to and claims the benefit of U.S. Non-provisional application Ser. No. 15/556,709 filed on Sep. 8, 2017, which in turn claims the benefit of PCT International Patent Application Number PCT/US2016/021921, filed on Mar. 11, 2016, which in turn claims the benefits of U.S. Provisional Patent Application Ser. No. 62/131,319 filed Mar. 11, 2015, the entirety of each prior application is incorporated herein by reference.

BACKGROUND

1. Technical Field

This disclosure relates generally to the pulping of lignocellulosic materials, which may be referred to as "wood chips" or simply "chips" throughout this disclosure. More specifically, the present disclosure relates to the conversion of lignocellulosic materials into pulp through semi-chemical pulping and chemi-mechanical pulping processes.

2. Related Art

In the pulp and paper industry, there are basically two fundamentally different processing methods for converting lignocellulosic material, being wood or non-wood, into the pulp used in papermaking. The two processes for converting lignocellulosic material into pulp are chemical pulping and mechanical pulping.

Chemical pulping uses chemicals including, but not limited to sodium hydroxide, sodium sulfide, sodium sulfite or different solvents (often referred to as "cooking chemicals") to break down bonding between each individual fiber. The chemical pulping methods cook lignocellulosic materials to liberate the fibers. Fiber liberation occurs when the middle lamella of the wood chip fiber matrix is chemically dissolved to an extent that makes comminution possible without further mechanical treatment in mechanical pulping equipment. In chemical pulping, a digester is used to cook the lignocellulosic material; the cooking severity depends on the cooking chemicals applied along with time and temperature. The cooked material is removed from the digester, typically by an outlet device as shown in U.S. Pat. No. 6,123,808 or converging transitions employing single convergence and side relief as shown in statutory patent registration no. US H1681, or other means not resulting in liberating the fibers of the lignocellulosic material. Chemical pulping processes have a drawback: high wood consumption, which can result in yields of wood as pulp of only about 55% to 70%. The chemical pulping process consumes wood at higher rate compared to the mechanical pulping processes.

Mechanical pulping processes use equipment to break apart the wood chips fiber matrix of lignocellulosic materials to produce pulp. The mechanical pulping processes employ mainly mechanical means such as rotating discs commonly referred to as refiners, or a rotating grinding stone, to separate the lignocellulosic fibers from one another. Purely mechanical pulping processes using refining, cause some of the fiber walls to rupture and result in pulps containing substances resulting from the rupture of the fiber walls. Because of the presence of substances from the rupture of fiber walls, such as fines, mechanical pulps may not have quality requirements for some uses. Fines are small particles of fiber that are shorter than normal wood pulp fibers. Typically the yield of mechanical pulping processes is in the range of 92% to 98%. In purely mechanical pulping processes, by the absence of chemical addition, no loss of wood fibers as a result of cooking chemical reactions occurs.

Other processes combining mechanical refining and chemical treatments similar, but not limited to, chemical pulping are known as semi-chemical pulping and chemi-mechanical pulping. Chemi-mechanical pulping utilizes chemicals prior to the refining stage to limit the rupture of the fiber cell walls during refining. Limiting the rupture of fiber cell walls during refining, results in higher quality pulp. The applied chemical charges are relatively low, for example, typically 1% to 4% of chemical per wood chip weight for chemi-mechanical pulping, compared to chemical pulping, which typically have chemical charges of about 15% to 25%, and therefore the chemical reactions require significantly less reaction time, thereby reducing the need for a digestion vessel specifically designed for chemical digestion.

Semi-chemical pulping applies higher chemical charges (typically 4% to 7%) compared to chemi-mechanical pulping (1% to 4%), yet lower chemical charges compared to chemical pulping (about 15% to 25%). In semi-chemical pulping, the applied chemical charge is high enough to require a digestion vessel similar to the digestion vessels used in chemical pulping; however, the charge is not high enough to liberate the fibers without the use of mechanical refiners as used in mechanical pulping. The yield of both semi-chemical and chemi-mechanical pulping processes is between the yield of chemical pulping and mechanical pulping. More specifically, chemi-mechanical pulping reaches yields in the range of 80% to 92% and semi-chemical pulping reaches yields of 70% to 85%.

Most commonly in semi-chemical and chemical pulping processes, the lignocellulosic feed material undergoes pre-steaming in a steaming vessel. The cooking chemicals are added, the cooking chemicals may be added during or after pre-steaming, and the lignocellulosic material is fed to the digester stage. Depending on the process, either high-pressure pumps or compression screws are used to create a pressure gate. The pressure gate may also refer to as a pressure seal. The pressure gate is disposed between the atmospheric process stage and the super-atmospheric pressure stage (such as the digestion stage) of the system. Some installations also have a chip washing stage. A chip washing stage is included in the system to remove sand, stones and other material that is detrimental to the lignocellulosic material prior to digestion and refining. By using a chip washing stage, the maintenance and cleaning intervals for equipment in the stage subsequent to chip washing may increase. It is also possible that a chip washing stage may help to increase the life time of refiner plates used in the refining stage.

Known chemi-mechanical and semi-chemical pulping processes typically involve process stages that are operated at atmospheric pressure and stages operating at super-atmospheric pressures. This separation of stages operating at differing pressures is possible by the use of a pressure gate or pressure seal. The pressure gate or pressure seal is most commonly achieved by the installation of a compression stage. Compression screws, also referred to as plug screw feeders may be used in the compression stage. The use of compression screws or plug screw feeders allows the feeding of the lignocellulosic material from the atmospheric stages of the process to the pressurized or super-atmospheric stages of the process. Pressurized or super-atmospheric stages may be a pressurized refiner or a pressurized digestion stage (a pressurized digester vessel). In the compression stage, the lignocellulosic material is compressed, but the nature of the lignocellulosic material is not changed. It is also possible to use a rotary valve, or even high-pressure slurry pumps to achieve the separation and associated pressure gate or pressure seal.

Known chemi-mechanical pulping processes may involve one or several mechanical pretreatment stages of the lignocellulosic materials. Such mechanical pretreatment stages involve changes to the nature of the lignocellulosic material such as maceration or fiberization. In one type of pretreatment process, the lignocellulosic material may be fed through a compression screw device to achieve a degree of maceration of the lignocellulosic material. Here, maceration is referred to as a partial delamination of the lignocellulosic material structure in the longitudinal direction without fiber damage. Said another way, maceration is the opening up of the fiber structures and the partial breaking down of the lignocellulosic material individual piece size to increase the surface area of the lignocellulosic material. Maceration further involves removal of detrimental substances such as resins, colloids and dissolved materials. Removal of free liquids between individual pieces of the lignocellulosic material increases consistency and homogenization. Compressing volumes of the bulk lignocellulosic material removes air trapped in voids.

Known processes for semi-chemical pulping using compression screws do not involve maceration of lignocellulosic material. In other known mechanical and chemi-mechanical pulping processes, fiberization stages are used for pretreatment of the lignocellulosic material. Fiberization may be accomplished by mechanical refiners. In known semi-chemical pulping processes as discussed here, mechanical pretreatment stages such as fiberization are not applied.

Typically, in chemi-mechanical and semi-chemical pulping, chemicals are applied after mechanical compression or, in the case of chemi-mechanical pulping only, after mechanical pretreatment of the lignocellulosic material. Chemicals used in chemi-mechanical and semi-chemical pulping may include, but are not limited to, alkaline peroxide, alkaline sulfite, caustic soda, alkaline based cooking chemicals, oxalic acid, or other acid compounds used for cooking, and water, depending on the nature of the process.

While semi-chemical pulping processes may have compression of the lignocellulosic material, the compression is not carried out by equipment which compresses the lignocellulosic material to the level of maceration.

BRIEF SUMMARY OF THE INVENTION

Applicant has discovered that existing semi-chemical processes that have compression have the disadvantage of non-uniform and uneven distribution of chemicals due to variation in lignocellulosic particle sizes and incomplete absorption of chemicals into the lignocellulosic material prior to further processing.

The present disclosure generally relates to an effort to address and improve shortcomings of the conventional chemical and semi-chemical pulping processes with regard to diffusion and absorption of the chemicals into the lignocellulosic material at or just after compression thereby reducing the digestion stage retention time and operating temperature, as well as reduced cooking chemical needed. To improve the diffusion and absorption of chemicals into the lignocellulosic material at or just after compression, the current disclosure seeks to provide an improved system and process for semi-chemical pulping and chemical pulping. This disclosure generally relates to a system and process of producing pulp from lignocellulosic material after the lignocellulosic material has undergone mechanical pretreatment prior to digestion. More specifically, the disclosed system and process are directed to producing pulp from lignocellulosic material that has undergone compression, maceration and removal of extractives followed by chemical addition, fiberization, digestion and further mechanical refining. Prior to this disclosure, semi-chemical pulping processes did not have a maceration step. The maceration step was not included in semi-chemical pulping because equipment configured to apply sufficient compression and shear forces needed to initiate the comminution process did not exist. The invention enables more efficient and uniform absorption of liquid in the lignocellulosic material. Fiberization of lignocellulosic material prior to digestion was not available to pulping processes due to the high energy required for mechanical pulping, specifically fiberization. Because of the high energy required, the standard for mechanical refining was to process the lignocellulosic material completely to pulp rather than stopping at fiberization where further processing would be required to achieve pulp. Applicant has discovered that by adding a fiberizing step in the processing of the lignocellulosic material prior to a digestion step, improved chemical diffusion and absorption into the lignocellulosic material can be achieved. By improving chemical diffusion and absorption into the lignocellulosic material, less chemical and less retention time in the digestion step may be required.

Maceration can be achieved by the application of a high-compression screw device which is most commonly installed prior to the chemical application and digestion step. Fiberization can be achieved a disc refiner.

Without being bounded by theory, the macerated or fiberized lignocellulosic material provides increased surface area, which improves distribution and absorption of chemicals to the lignocellulosic material for the chemical reaction in the downstream digestion stage. Applicant has discovered that this improved distribution and absorption of chemicals decreases the time needed in the digestion stage, that is, reduces the digestion stage retention time. By reducing the digestion stage retention time, greater throughput can be realized using existing digestion equipment. However, if new digestion equipment is to be installed, the new digestion equipment may be smaller in size. Another benefit of the present disclosure is a lower digester stage operating temperature and a reduced quantity of cooking chemicals may be needed. When compared to known chemical or semi-chemical pulping processes, the disclosed process may have up to 70%, or up to 60% or up to 50%, shorter digesting time. It is an object of the present disclosure to reduce the size of the digesting vessel. It is a further object of the present disclosure to reduce the quantity of chemicals used by 5% to 15%. It is yet a further object of the present disclosure to reduce the temperature within the digester by 10° C. to 15° C.

In cases where a maceration stage is used, chemical addition is made after compression and maceration but before the pretreated lignocellulosic material enters the digestion stage. Preferably, chemicals are added at the discharge end of the compression screw device. The discharge end of the compression screw device is where decompression of the lignocellulosic material begins. By adding the chemicals where decompression of the lignocellulosic material begins, the chemicals are may be more easily pulled into the expanding lignocellulosic material.

In cases where both maceration and fiberization stages are used, chemical addition can be distributed between any location prior to the digestion stage. Chemicals can be added at the eye of the fiberizer, at other locations within the fiberizer, or after the fiberizer. While in the fiberizer, the lignocellulosic material is broken into coarse fiber particles (also referred to as fibers) and fiber bundles. By opening the fiber matrix of the coarse fibers, cooking chemicals may penetrate and diffuse into the fibers of the lignocellulosic material more easily and the efficiency of the digestion may be improved. As a result of improved digestion efficiency, chemical consumption may be reduced. As a further result of the processes of this disclosure, the temperature of digestion may be lowered and the reaction time in the digester may be shortened. Upon leaving the fiberizer, the coarse fibers may be sent to a digester vessel or like equipment where additional cooking chemicals may be added. After digestion, the cooked lignocellulosic material is further treated in a mechanical treatment stage, such as a mechanical refiner. Further treatment in the mechanical treatment stage allows the cooked lignocellulosic material to be comminuted and defibrated.

Another exemplary embodiment of the disclosure includes fiberization prior to digestion without prior maceration. In these embodiments, the preheated and washed lignocellulosic material may be fed directly to a fiberizer or may be passed through a compression screw, plug screw feeder or the like, then into a fiberizer. The fiberizer may be a mechanical refiner. In the fiberizer, the lignocellulosic material is broken into coarse fibers and fiber bundles. Breaking of the lignocellulosic material into fibers or fiber bundles provides an increased surface area for the cooking chemicals to penetrate and diffuse into the lignocellulosic material. Chemicals may be added at either the eye of the fiberizer or at other locations within the fiberizer.

The lignocellulosic material generally undergoes both chemical and mechanical treatment during comminution from wood chips to fiber bundles and further to single fiber fibrillation. Here, "fibrillation" describes the external disruption of lateral bonds between surface layers of a fiber that results in partial detachment of fibers or small pieces of the outer layers of the fiber and the internal or lateral bonds between adjacent layers within a fiber and usually occurs during the mechanical refining of pulp slurries.

One objective of this disclosure is to reduce the retention time (reaction time) in the initial delignification step by enhancing the diffusion and absorption of chemicals into the lignocellulosic material. This enhanced diffusion and absorption of chemicals is largely the result of providing a larger surface area and shorter diffusion paths for the chemicals when the chemicals are first introduced to lignocellulosic material.

Possible additional benefits of the invention enable removal of extractives and other detrimental substances, such as colloidal material and inorganic and organic dissolved solids, from the lignocellulosic material prior to chemical addition and digestion. Thus, the efficiency of the digestion stage is improved and chemical addition rate is decreased.

DETAILED DESCRIPTION

This disclosure generally relates to a system and process of producing pulp from lignocellulosic material after the lignocellulosic material has undergone compression (pressurization), maceration and removal of extractives produced during compression and maceration followed by chemical addition, fiberization, digestion (cooking) and further mechanical refining.

The following detailed description of the preferred embodiments is presented only for illustrative and descriptive purposes and is not intended to be exhaustive or to limit the scope and spirit of the invention. The embodiments were selected and described to best explain the principles of the invention and its practical application. A person of ordinary skill in the art will recognize many variations can be made to the invention disclosed in this specification without departing from the scope and spirit of the invention.

Figure 1:
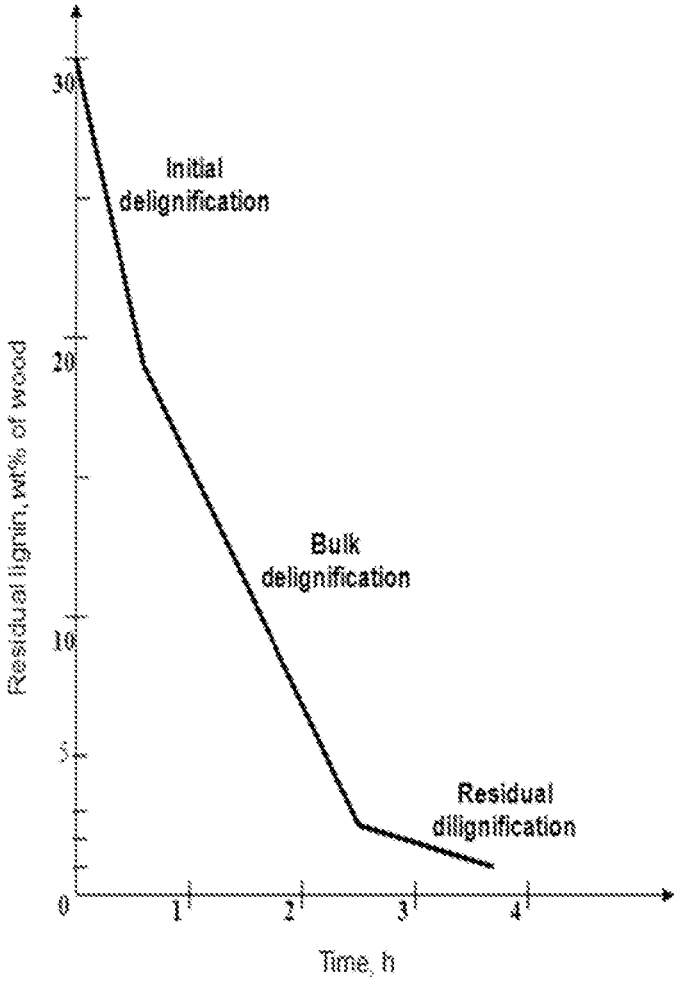
FIG. 1 is a conceptual graph of the retention times in chemical and semi-chemical pulping processes.

FIG. 1 is a graph of the retention times of lignocellulosic material and chemicals for chemical and semi-chemical pulping processes. Retention times, also referred to as reaction times, are important to the delignification of lignocellulosic material. The x-axis of FIG. 1 is time in hours, while the y-axis is the residual lignin present expressed as the weight percent ("wt %") of wood. The reaction time for chemical and semi-chemical pulping processes as shown in FIG. 1 is comprised of three steps. The three steps are "initial delignification", "bulk delignification" and "residual delignification".

Approximately thirty percent (30%) of lignocellulosic material is lignin. The aim of the chemical and semi-chemical pulping processes is to reduce the lignin present in the pulp product produced from lignocellulosic material. The reduction of the lignin in the lignocellulosic material begins in a pre-heating and impregnation step called the "initial delignification". The reaction time for initial delignification begins with heating and impregnating of the lignocellulosic material with chemicals. The length of the initial delignification reaction time is determined by the diffusion of chemicals into the fiber walls of the lignocellulosic material.

The second step of delignification, typically the step having the longest duration and where the greatest percentage of lignin is removed, is "bulk delignification". Bulk delignification is considered by most to be the cooking process. During bulk delignification, the reaction time is typically the longest and is largely a function of the chemical reactions of the lignin and the cooking chemicals. Temperature of the lignocellulosic material and the cooking chemicals, usually temperature is the highest in this step, as well as the concentration of the cooking chemicals, usually the highest concentration of chemicals, impact the reactions between the lignin and the cooking chemicals, and therefore impact the reaction time. As a result of the high temperature and high level of chemical concentration as well as the longest reaction time, most of the lignin is removed during bulk delignification.

The third step of delignification is "residual delignification". Typically residual delignification occurs after the digestion step during the bleaching and washing stages. Bleaching chemicals added to the digested or cooked lignocellulosic material, at least to some degree, provide delignification. Typically, the smallest percentage of delignification occurs in the residual delignification step.

Figure 2:
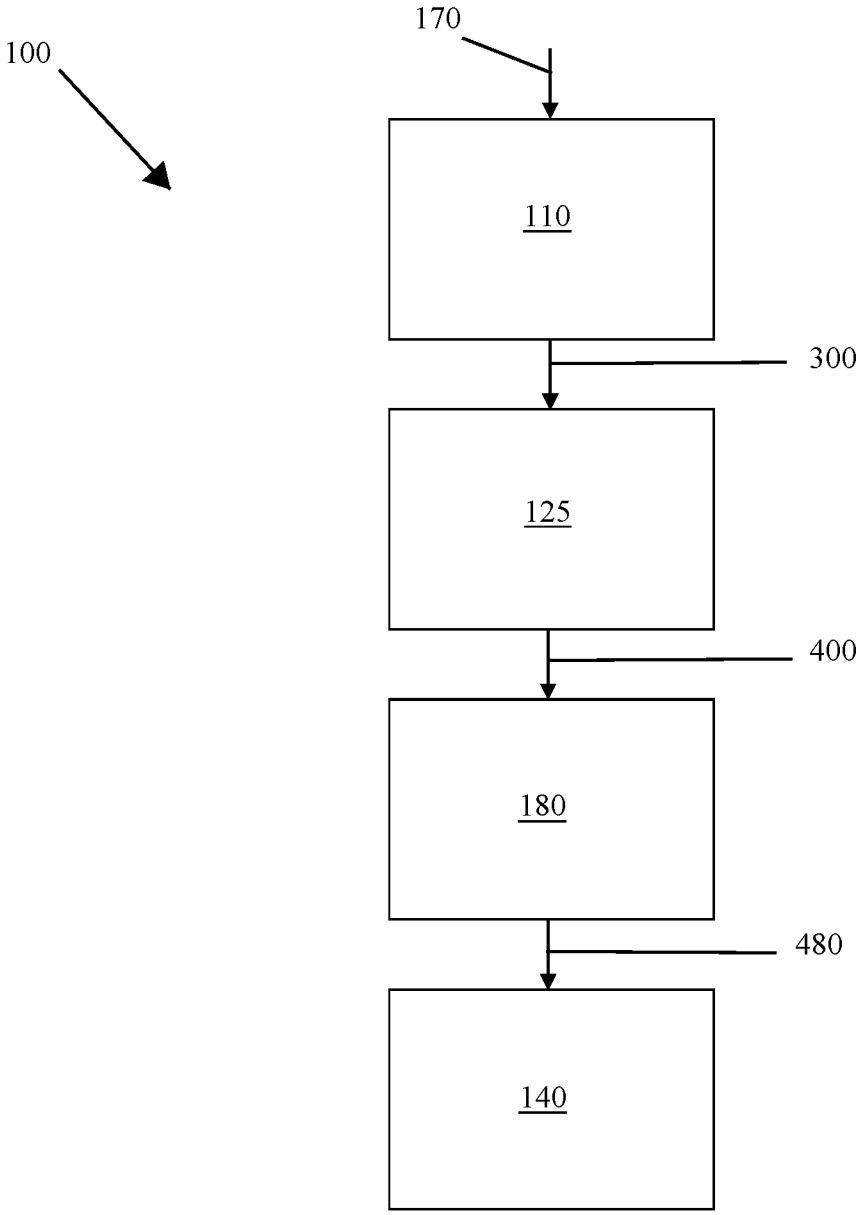
FIG. 2 is a process diagram of the process including compression and maceration without fiberization prior to digestion.

FIG. 2 shows a process 100 where lignocellulosic material 170 enters a washing and dewatering step 110. In the washing and dewatering step 110, the lignocellulosic material 170 is washed to remove impurities from the lignocellulosic material 170 followed by a dewatering phase where excess liquid may be removed prior to a compression, maceration, and chemical addition step 125, thereby forming a compressed, macerated and impregnated lignocellulosic material 400.

The compression, maceration, and chemical addition step 125 may use multiple devices or a single compression and macerating device such as a plug screw feeder, for example a MSD Impressafiner® sold by Andritz, Inc. of Alpharetta, Ga., or other device suitable to both compress and macerate the washed and dewatered lignocellulosic material 300. It is important to have the washed and dewatered lignocellulosic material 300 compressed by a device capable of at least a 2.5 to 1 compression ratio, or a 4 to 1 compression ratio, or a 5 to 1 compression ratio (including all compression ratios in between). The compression ratio is defined as inlet volume of the compression zone related to the outlet volume of the compression zone. Such a compression ratio allows sufficient pressurization on the washed and dewatered lignocellulosic material 300 to ensure proper chemical absorption.

The device used for compression may be further used for maceration or a separate device may be used for the maceration phase. Maceration allows the softening and separation of lignocellulosic material into its component parts (fibers) by the application of physical mechanical treatment. Maceration results in breaking lignocellulosic material into fibers or commonly referred to as "match sticks". Maceration increases the surface area available to absorb the chemicals. If multiple devices are used for compression and maceration, care should be taken to maintain the compressed form of the washed and dewatered lignocellulosic material 300 while the washed and dewatered lignocellulosic material 300 undergoes maceration. It is important to maintain pressure (from compression) and have maceration of the washed and dewatered lignocellulosic material 300 prior to addition of chemical.

The addition of chemicals such as but not limited to white liquor, black liquor, green liquor, alkaline based chemicals, sulfite based chemicals, water, or other chemicals suitable for digesting or cooking should be made once the washed and dewatered lignocellulosic material 300 has been macerated to form fibers and fiber bundles but is still in a state of compression. Once the chemicals have been introduced, compression forces may be released allowing the chemicals to be pulled into the cells of the macerated fibers, thereby forming the compressed, macerated and impregnated lignocellulosic material 400. By introducing chemicals only after maceration and while under compression, the volume of chemical absorbed by the washed and dewatered lignocellulosic material 300 is greater than in known processes where chemicals are added after compression alone or after maceration alone. Another term for this absorption of chemicals at this step is "impregnation".

A digester step 180 may operate in continuous or batch mode. If continuous mode is used, a single digester or multiple digesters in series or parallel may be operated. If batch mode is used, multiple digesters operating alternately so as to accommodate continuous transfer of compressed, macerated and impregnated lignocellulosic material 400 to the digester step 180 and continuous feed of digested lignocellulosic material 480 from the digester step 180.

In the digester step 180, a digester vessel is operated at temperatures of 120° C. to 190° C. depending of the lignocellulosic material to be treated. The digester vessel may be horizontal, vertical, or inclined orientation. Additionally, the digester vessel may operate in concurrent or countercurrent or a combination of concurrent and countercurrent mode. In this context, concurrent flow within the vessel means flow of solid material is in the same direction as any added liquid. Also, the digester vessel may be operated at high or low consistency, expressed as liquor to wood ratio (L/W). Typically L/W ratios are in the range of 2.0 to 5.0, but ranges of 1.5 to 9.0 are possible. If a vertical digester vessel is used, it is possible for the digester vessel to have compressed, macerated and impregnated lignocellulosic material 400 enter the digester vessel at the top of the digester vessel and be removed from the digester vessel at the bottom, or vice versa. If a horizontal digester vessel is used, compressed, macerated and impregnated lignocellulosic material 400 enters at one end and is discharged at the opposite end. If an inclined digester vessel is used, compressed, macerated and impregnated lignocellulosic material 400 may enter at either the end and be discharged from the opposite end.

The digested lignocellulosic material 480 from the digester step 180 is fed to a further processing step 140. The further processing step 140 may involve multiple operations including, but not limited to, mechanical refining, washing, bleaching, etc. to produce a pulp suitable for paper, cardboard or other known final uses. In this embodiment, there is no fiberizing step, prior to the digester step 180.

Known processes use compression without maceration followed by chemical addition and digestion then further processing such as refining. In another known process, maceration without compression followed by chemical addition and digestion then further processing such as mechanical refining. In using the process of this disclosure, it is possible to reduce the digester time by up to 50%, up to 40%, up to 20%, up to 10% while obtaining the same pulp quality as known processes. By reducing time within the digester vessel, an increase in throughput can be realized thereby increasing the production capacity of pulp from existing equipment by up to 50%, up to 40%, up to 20%, up to 10%.

By implementing the disclosed process, chemical consumption within the digester vessel can be reduced by 5% to 15%, 8% to 12%, over known processes when time and temperature within the digester vessel is kept similar as in known processes. Reduced chemical consumption may result in lower operating costs while maintaining pulp production volume and pulp quality.

In another implementation of the process, by maintaining the retention (reaction) time within the digester vessel, it is possible to reduce the temperature of the digester by 10° C. to 15° C. when compared to known processes. Operating the digester vessel at lower temperatures may result in reduced steam consumption to heat the digester vessel and its contents while producing the sample pulp volume and maintaining the same pulp quality. In such cases, the operating costs relating to steam production and consumption may be reduced.

In implementing the disclosed process, it is also possible to reduce the size of the digester vessel. A smaller digester vessel may reduce capital investment costs incurred while providing the same volume of pulp having the same pulp properties as known processes.

Figure 3:
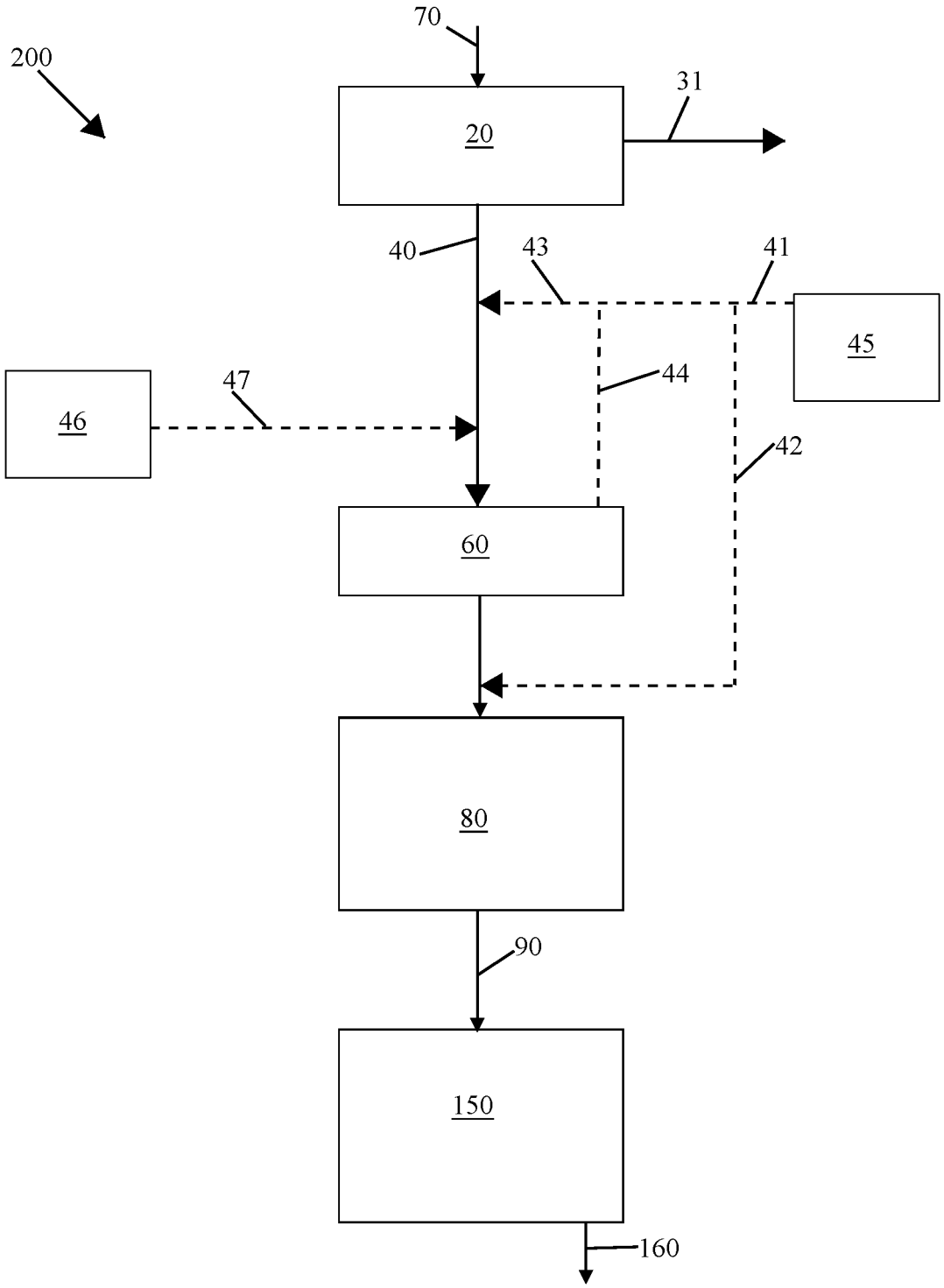
FIG. 3 is a process diagram of the process disclosed with compression, maceration and extractives removal plus fiberization prior to digestion.

FIG. 3 shows a preconditioning with compression process 200 where lignocellulosic material 70 is fed to the compression and maceration step 20. Similar reference numbers used in FIG. 3 corresponds to similar steps or lines from FIG. 2 unless otherwise stated.

Prior to being fed to the compression and maceration step 20, the lignocellulosic material 70 may have been washed, dewatered, and pre-steamed to remove impurities. The lignocellulosic material 70, with or without any one or multiple of washing, dewatering and pre-steaming step, may be fed to the compression and maceration step 20 where a compressed and macerated lignocellulosic material 40 is formed. As a result of the compression and maceration step 20, extractives and impurities 31 may be produced and removed. Removed extractives and impurities 31 can be collected as a separate product stream for further processing. A solvent may be added to the compression and maceration step 20 to assist in removal of the extractives. It is desirable to remove the extractives after the compression and maceration step 20 because after the compression and maceration step 20, extractives are at their highest concentration prior to the addition of other process chemicals. It is possible that a single compression and maceration device, such as a screw plug feeder, for example an MSD Impressafiner® device sold by Andritz, Inc. of Alpharetta, Ga., or other device suitable for the compression, maceration and removal of extractives, is used or multiple devices may be used to achieve compression, maceration and extractives removal.

From the compression and maceration step 20, the compressed and macerated lignocellulosic material 40 is transferred to a fiberizer step 60. Prior to the fiberizer step 60, cooking chemicals 45 for delignification may be added via chemical addition lines 41 and 43. The fiberizer step 60 may include one or more fiberizers and undergoes fiberization, (also referred to as fiberizing). It is also possible to add cooking chemicals 45 to the fiberizer step 60, specifically to the eye of the fiberizer via chemical addition lines 41 and 44. In some cases chemical addition lines 41 and 42 may be used to add cooking chemicals 45 after the fiberizer step 60. It is possible to add fiber protection chemicals 46 via fiber protection chemical line 47 prior the fiberizer step 60. The fiber protection chemicals soften the lignin between the fibers allowing for the fiber separation to take place in the middle lamella (high lignin content area between the individual fibers) instead of the fiber cell wall.

Once in the fiberizer step 60, compressed and macerated lignocellulosic material 40 is treated by a fiberizer to produce a fiberized material 71. The fiberized material 71 typically is comprised of coarse fibers and fiber bundles. The coarse fibers have a reduced particle size to allow for easy delignification in the process steps to follow. From the fiberizer step 60 the fiberized material 71 is transferred to the digester step 80. Should it be desired, excess liquid in the fiberized material 71 may be removed prior to feeding the fiberized material 71 to the digester step 80. Depending on the application, the fiberization can be conducted either under elevated saturated steam pressure or under atmospheric conditions.

The fiberized material 71 is fed to the digester step 80 where it is contacted with cooking chemicals 45 and delignified, that is the fiberized material 71 undergoes removal of lignin from the solid portion of the fiberized material 71. Once the fiberized material 70 is treated and de-lignified in the digester step 80, a digested material 90 is formed. The digester step 80 may operate in continuous or batch mode. If continuous mode is used, a single or multiple digesters in series or parallel may be operated. If batch mode is used, multiple digesters operating alternately so as to accommodate continuous transfer of fiberized material 71 to the digester step 80 and continuous discharge of digested material 90 from the digester step 80 to further refining steps 150.

From the digester step 80, the digested material 90 may proceed to further mechanical pulping processes, identified here as further refining step 150. Further refining step 150 may include, but not be limited to, mechanical refining, bleaching, washing and other specific processes to produce pulp 165.

In the digester step 80, digester vessel is operated at temperatures of 120° C. to 190° C. depending of the lignocellulosic material to be treated. The digester vessel may be horizontal, vertical, or inclined orientation. Additionally, the digester vessel may operate in concurrent or countercurrent or a combination of concurrent and countercurrent fashion. In this context, concurrent flow within the vessel meaning flow of solid material is in the same direction as any added liquid.

If a vertical digester vessel is used, it is possible for the digester vessel to have fiberized material 71 enter the digester vessel at the top of the digester vessel and be removed from the digester vessel at the bottom, or vice versa. If a horizontal digester vessel is used, fiberized material 71 enters at one end and is discharged at the opposite end. If an inclined digester vessel is used, fiberized material 71 may enter at either end and be discharged from the opposite end. The digester vessel and operation may be one known in the art, such as described in U.S. Pat. No. 8,262,851 incorporated here in its entirety by reference.

Figure 4:
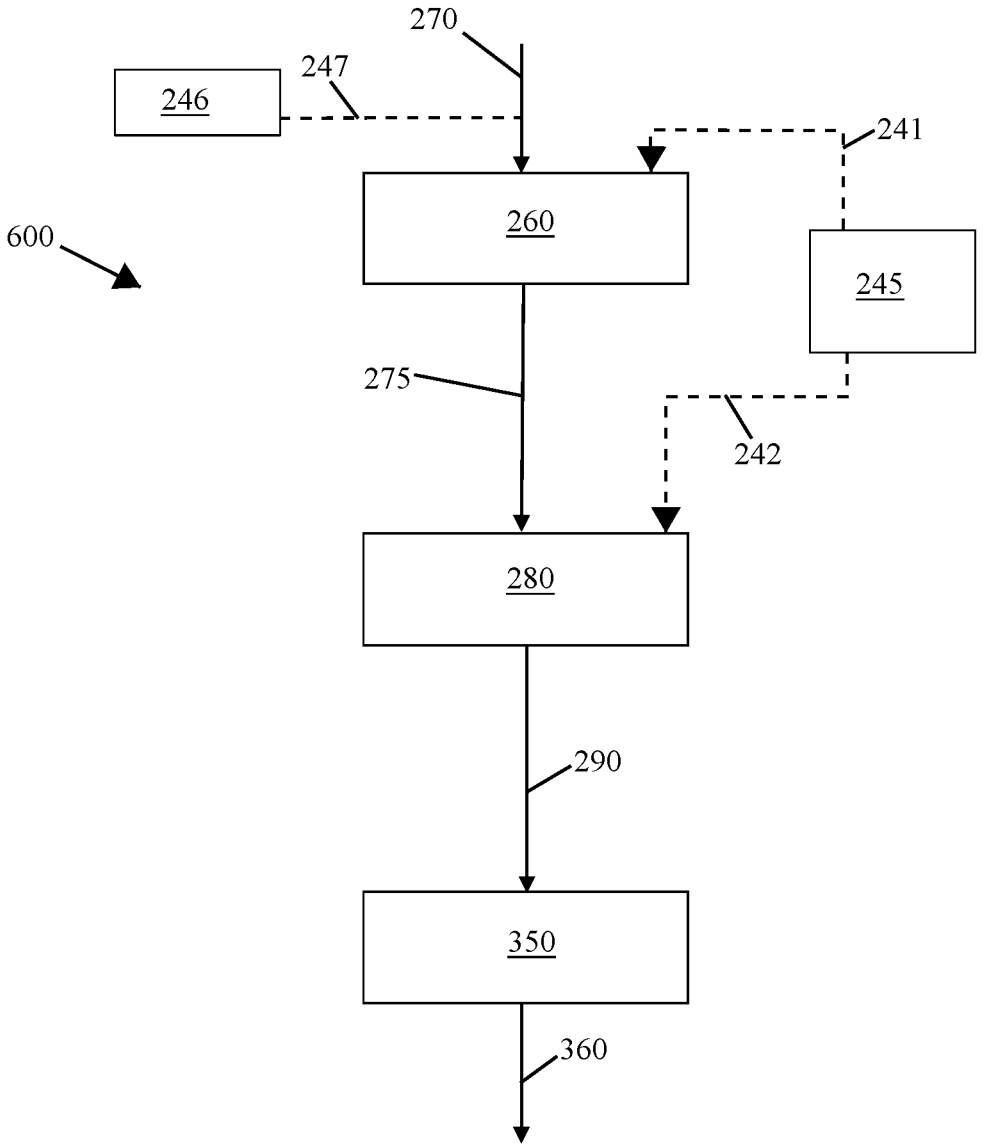
FIG. 4 is a process diagram of the process disclosed without compression, maceration and extractives removal but fiberization before digestion.

FIG. 4 is a process diagram of a preconditioning process without compression 600. There are similarities between the processes of FIG. 2, FIG. 3 and FIG. 4. Where possible, reference numbers used in FIG. 4 correspond to similar steps or lines from FIG. 2 or FIG. 3.

Lignocellulosic material 270 is fed to a fiberizer step 260 without prior maceration of the lignocellulosic material 270. The fiberizer step 260 includes at least one fiberizer device. Prior to being fed to the fiberizer step 260, the lignocellulosic material 270 may have been washed, dewatered, and pre-steamed. The lignocellulosic material 270 may have been washed to remove impurities, followed by a dewatering phase where excess liquid may be removed prior to being fed to the fiberizer step 260. It is possible to add fiber protection chemicals 246 via fiber protection chemical line 247 prior the fiberizer step 260. The fiber protection chemicals soften the lignin between the fibers allowing for the fiber separation to take place in the middle lamella (high lignin content area between the individual fibers) instead of the fiber cell wall.

As with the previous embodiment, cooking chemicals 245 for delignification may be added to the fiberizer step 260 via chemical addition line 241 or to the digester step 280 via chemical addition line 242 or both. Cooking chemical 245 addition associated with the fiberizer step 270 may be made before the fiberizer step 260, at the eye of the fiberizer within the fiberizer step 260 or after the fiberizer step 260.

Once in the fiberizer step 260, lignocellulosic material 270 is treated by the at least one fiberizer device to produce coarse fibers. The coarse fibers have a reduced particle size to allow for easy delignification in the process steps to follow. From the fiberizer step 260 a fiberized material 275 is transferred to the digester step 280. Fiberized material 275 has been treated by the fiberizer step 260 and has the form of coarse fibers with reduced particle size. Should it be desired, excess liquid in the fiberized material 275 may be removed prior to feeding fiberized material 275 to a digester step 280.

Within the digester step 280, the fiberized material 275 is treated to de-lignify the fiberized material 275. The digester step 280 may have at least one digester vessel and operation of the at least one digester vessel may be one known in the art, such as described in U.S. Pat. No. 8,262,851 incorporated here in its entirety by reference. After delignification in the digester step 280, digested material 290 is discharged from the digester step 280 and continues to a further refining step 350 to produce pulp 365. Further refining step 350 may include mechanical refining, washing, bleaching or other treatments used in the production of desired pulp.

A semi-chemical pulping process for the pulping of lignocellulosic material is disclosed where a lignocellulosic material is accepted by a compression, maceration and chemical addition step. The lignocellulosic material undergoes compression, maceration and chemical addition in the compression, maceration and chemical addition step to form a compressed, macerated and impregnated lignocellulosic material. Feeding the feeding the compressed, macerated and impregnated lignocellulosic material to a digester step wherein the digester step comprises at least one digester vessel configured to receive the compressed, macerated and impregnated lignocellulosic material. Heating the digester vessel and its contents to digesting temperature and maintaining at digesting temperature for a time necessary to produce digested lignocellulosic material. Feeding the digested lignocellulosic material to a further processing step, wherein the digested lignocellulosic material undergoes at least one of mechanical refining, washing, bleaching; and wherein there is no fiberizing or fiberizer step prior to the digester step. The compressed and macerated lignocellulosic material having been compressed and macerated is chemically impregnated prior to the release of compression. When the system disclosed is used the digester vessel is operated 10° C. to 15° C. lower than when chemical impregnation occurs with compression only or maceration only. Using the system disclosed the time in the digester vessel is up to 50% lower, or 40% lower, or 20% lower than when chemical impregnation occurs with compression only or maceration only. Cooking chemical consumption in the digester vessel, of the disclosure is 5% to 15% lower than when cooking chemical impregnation occurs with compression only or maceration only.

In some embodiments, the lignocellulosic material undergoes washing and dewatering prior to compression and maceration step or the compression, maceration and chemical addition step. In some embodiments, mechanical refining, washing, and bleaching stages may follow treatment in the digester.

A semi-chemical pulping process for the pulping of lignocellulosic material is disclosed where the semi-chemical pulping process comprises: feeding a lignocellulosic material to a compression and maceration step; compressing and macerating lignocellulosic material to form a compressed and macerated lignocellulosic material; feeding the compressed and macerated lignocellulosic material to a fiberizer step wherein one or more fiberizers is present; fiberizing the compressed and macerated lignocellulosic material to form a fiberized material; transferring the fiberized material to a digester step, the digester step comprising at least one digester vessel; contacting the fiberized material while in the digester step with cooking chemicals wherein the cooking chemicals cause the fiberized material to be de-lignified; de-lignifying the fiberized material to produce a digested material; transferring the digested material to a further refining step, wherein the further refining step includes one or more of mechanical refining, bleaching, washing, and other specific processes to produce pulp.

In some embodiments, the compression and maceration step are achieved in a single device. When the process disclosed is used the digester step is operated 10° C. to 15° C. lower than when chemical impregnation occurs with compression only or maceration only. Using the process disclosed, the time in the digester step is up to 50% lower, or 40% lower, or 20% lower than when chemical impregnation occurs with compression only or maceration only. Chemical consumption in the disclosed process, meaning chemical consumption in pretreatment (compression, maceration, chemical addition) and the digester, of the disclosure is 5% to 15% lower than when chemical impregnation occurs with compression only or maceration only.

In some embodiments, the lignocellulosic material undergoes washing and dewatering prior to the compression and maceration step. At least one embodiment includes the addition of cooking chemicals in at least one of before the fiberizer step, in the fiberizer step and after the fiberizer step. In some embodiments, mechanical refining, washing, bleaching stages may follow treatment in the digester.

A semi-chemical pulping system has been conceived comprising a fiberizer step and a digester step; where a lignocellulosic material is fed to the fiberizer step; the fiberizer step includes a fiberizer device configured to receive the lignocellulosic material wherein the lignocellulosic material is fiberized to form a fiberized lignocellulosic material; a digester step including a digester device configured to receive the fiberized lignocellulosic material; the digester step is followed by a mechanical refining step; and wherein the fiberized lignocellulosic material has the form of coarse fiber particles with an open fiber matrix suitable for delignification in the digester step.

In some embodiments of the semi-chemical pulping system, the lignocellulosic material is fed to a compression, maceration and extractives removal step prior to the fiberizer step. It is conceived that in at least some embodiments the compression, maceration and extractives removal step may be accomplished using a single device. In addition, some embodiments of the semi-chemical pulping system may include washing and dewatering of the lignocellulosic material prior to the fiberizer step or even prior to the compression, maceration and extractives removal step should one exist.

For some embodiments of the semi-chemical pulping system, fiber protection chemicals may be added to the lignocellulosic material at anyone of prior to, at the eye or after the fiberizer device. The chemical addition may occur either within or outside of the fiberizer step. Additionally, this chemical addition may occur even if the compression, maceration and extractive removal step exists.

In some embodiments of the semi-chemical pulping system, excess liquid from the fiberizer step may be removed prior to the digester step. For some embodiments of the semi-chemical pulping system, the mechanical refining step includes (but is not limited to) any one or more of a mechanical refining stage, a washing stage, a bleaching stage. A semi-chemical pulping process has been conceived comprising: feeding a lignocellulosic material to a fiberizer step without prior maceration; fiberizing the lignocellulosic material in the fiberizer step to form a fiberized lignocellulosic material; feeding the fiberized lignocellulosic material to a digester step; adding cooking chemicals to at least one of the fiberizer step and the digester step; de-lignifying the fiberized lignocellulosic material while in the digester step to produce a digested material; discharging the digested cellulosic material from the digester step to a further processing step; wherein the fiberized lignocellulosic material has the form of coarse fiber particles with an open fiber matrix suitable for delignification in the digester step. In at least some embodiments of the semi-chemical pulping process, the digester step includes at least one digester vessel.

In some embodiments of the semi-chemical pulping process, prior to the fiberizer step the lignocellulosic material under goes at least one of washing, dewatering and pre-steaming.

For some embodiments of the semi-chemical pulping process, fiber protection chemicals may be added to the lignocellulosic material at anyone of prior to the fiberizer step. The fiber protection chemical addition may occur either within or outside of the fiberizer step. In some embodiments, cooking chemicals are added to the lignocellulosic material at at least one of: prior to the fiberizer step, within the fiberizer step or after the fiberizer step.

In some embodiments of the semi-chemical pulping process, excess liquid from the fiberizer step may be removed prior to the digester step. For some embodiments of the semi-chemical pulping process, the further processing step includes (but is not limited to) any one or more of the following: a mechanical refining stage, a washing stage, a bleaching stage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A lignocellulosic material semi-chemical pulping process comprising:

feeding a lignocellulosic material to a compression and maceration step;

compressing and macerating the lignocellulosic material at a compression ratio of at least 2.5 to 1 to form a compressed and macerated lignocellulosic material;

feeding the compressed and macerated lignocellulosic material to a fiberizer step, wherein the fiberizer step comprises feeding the compressed macerated lignocellulosic material through one or more fiberizers;

fiberizing the compressed and macerated lignocellulosic material to form a fiberized material;

transferring the fiberized material to a digester step, wherein the digester step comprises feeding the fiberized material into a digester vessel to perform a digestion process that initiates de-lignification of the fiberized material; and contacting the fiberized material with cooking chemicals while the fiberized material is in the digester vessel.

2. The lignocellulosic material semi-chemical pulping process of claim 1, wherein prior to the feeding lignocellulosic material to the compression and maceration step, the lignocellulosic material undergoes at least one of a washing, dewatering, and pre-steaming step.

3. The lignocellulosic material semi-chemical pulping process of claim 1 further comprising transferring the digested material to a further refining step, wherein the further refining step includes one or more of mechanical refining, bleaching, washing, and other specific processes to produce pulp.

4. The lignocellulosic material semi-chemical pulping process of claim 1 further comprising de-lignifying the fiberized material to produce a digested material in the digester vessel.

5. The lignocellulosic material semi-chemical pulping process of claim 1, wherein prior to the fiberizer, the lignocellulosic material undergoes at least one of a washing, a dewatering, and a pre-steaming step.

6. The lignocellulosic material semi-chemical pulping process of claim 1, wherein fiber protection chemicals are added to the lignocellulosic material prior to the fiberizer.

7. The lignocellulosic material semi-chemical pulping process of claim 1, further comprising a further processing step including one or more of a mechanical refining stage, a washing stage, a bleaching stage.

* * * * *